US006875051B2

(12) United States Patent
Pizak

(10) Patent No.: US 6,875,051 B2
(45) Date of Patent: Apr. 5, 2005

(54) ELECTRICAL POWER DISTRIBUTION DEVICE

(75) Inventor: Stephen J. Pizak, King of Prussia, PA (US)

(73) Assignee: Design Research and Development Corp., King of Prussia, PA (US)

( * ) Notice: Subject to any disclaimer, the term of this patent is extended or adjusted under 35 U.S.C. 154(b) by 0 days.

(21) Appl. No.: 10/445,574

(22) Filed: May 27, 2003

(65) Prior Publication Data

US 2004/0242060 A1 Dec. 2, 2004

(51) Int. Cl.[7] ..... H01R 13/60
(52) U.S. Cl. ..... 439/535; 439/501; 439/652
(58) Field of Search ..... 439/4, 651, 652, 439/654, 501, 535

(56) References Cited

U.S. PATENT DOCUMENTS

| | | | | |
|---|---|---|---|---|
| 1,717,836 | A | | 8/1929 | Conner |
| D195,463 | S | | 6/1963 | Tamarin |
| D279,285 | S | | 6/1985 | Schwartz |
| D288,298 | S | | 2/1987 | Yang |
| D301,576 | S | | 6/1989 | Wang |
| D350,939 | S | | 9/1994 | Rossman et al. |
| D350,940 | S | | 9/1994 | Rossman et al. |
| 5,421,457 | A | * | 6/1995 | Listenberger ..... 206/388 |
| D366,865 | S | | 2/1996 | Stringer |
| D368,893 | S | | 4/1996 | Harwood et al. |
| 5,738,548 | A | | 4/1998 | Rutulante |
| D405,416 | S | | 2/1999 | Byrne |
| D420,643 | S | | 2/2000 | Yu |
| 6,042,426 | A | | 3/2000 | Byrne |
| 6,081,356 | A | * | 6/2000 | Branc et al. ..... 398/129 |
| D427,973 | S | * | 7/2000 | Giese ..... D13/139.6 |
| D431,529 | S | | 10/2000 | Giese |
| 6,179,665 | B1 | | 1/2001 | Rossman et al. |
| 6,200,159 | B1 | * | 3/2001 | Chou ..... 439/535 |
| D446,189 | S | | 8/2001 | Lee |
| D446,503 | S | | 8/2001 | Lee |
| D458,225 | S | | 6/2002 | Stecklenburg |
| D467,875 | S | | 12/2002 | Barger et al. |

* cited by examiner

*Primary Examiner*—Tho D. Ta
*Assistant Examiner*—James R. Harvey
(74) *Attorney, Agent, or Firm*—Law Offices of Arthur E. Jackson

(57) ABSTRACT

Provided is an electrical distribution device having three or more lateral surfaces, wherein at least two lateral surfaces are adjacent pyramidal surfaces, wherein each such adjacent pyramidal surface comprises a directionally biased power receptacle, wherein each such adjacent pyramidal surface is adapted to direct a bulky end of a transformer fitted therein downwards or in a lateral direction; wherein for downwardly-biased pyramidal surfaces, the portion of the pyramidal surface below the power receptacle is adapted to accommodate about two inches or more of a bulky end of a transformer fitted in the power receptacle; wherein laterally-biased pyramidal surfaces are adapted so that any transformer that extends over an edge of the relevant pyramidal surface towards an adjacent pyramidal surface so extends at an angle such that a transformer of high primary bulk could still be accommodated fitted into the biased power receptacle at such adjacent pyramidal surface.

20 Claims, 14 Drawing Sheets

ELECTRICAL POWER DISTRIBUTION DEVICE

This invention relates to an electrical power distribution device designed to provide power to multiple devices simultaneously in a space-efficient manner. More particularly, the present invention relates to a power distribution device that is shaped in such a way as to be capable of distributing power to a plurality of devices that may have transformer blocks or otherwise large plugs, without causing the obstruction of other outlets on the device. This device may also provide surge protection to connected devices on any combination of power, communication, or video jacks incorporated into the design.

As a result of the large number of devices that use large electrical cords with transformers positioned at the end of the cords, adjacent or opposing outlets on commonly used power strips or surge protectors are often obscured, and thereby blocked by a connected device. This obstruction often prevents the use of other power receptacles on the power strips, which frequently leads to the unsafe and disorganized practice of 'piggybacking' power strips onto each other. Such obstruction can also lead to the practice of inserting plugs at an angle not orthogonal to the power strip's surface which is not only unsafe, but can damage the connected electrical device. A power distribution device that is capable of simultaneously providing power to multiple components with large plugs, while also providing a more stable base is desired.

Also common is the growing use of devices using communication connections, such as computers, fax machines, and components that utilize coaxial cable connections (e.g., satellite or cable TV boxes). For the most efficient use of space, it is desirable to be able to connect such components to a single electrical distribution device. Ideally these connected components are protected from electrical spikes, surges, and sags via their connection to the present invention.

SUMMARY OF THE INVENTION

The present invention provides electrical power distribution to a plurality of connected devices via multiple electrical sockets or jacks. The present invention is shaped in such a way as to allow the simultaneous connection of more than one connected component, which may include any combination of standard electrical cords or electrical cords with transformers or other large, space-consuming plug configurations.

In one aspect, the invention relates to an electrical distribution device having three or more lateral surfaces having at least two lateral surfaces which are adjacent pyramidal surfaces. Each such adjacent pyramidal surface includes a directionally biased power receptacle, wherein each such adjacent pyramidal surface is adapted to direct a bulky end of a transformer fitted therein downwards or in a lateral direction. For downwardly-biased pyramidal surfaces, the portion of the pyramidal surface below the power receptacle is adapted to accommodate about two inches or more of a bulky end of a transformer fitted in the power receptacle. Laterally-biased pyramidal surfaces are adapted so that any transformer that extends over an edge of the relevant pyramidal surface towards an adjacent pyramidal surface so extends at an angle such that a transformer of high primary bulk could still be accommodated fitted into the biased power receptacle at such adjacent pyramidal surface.

In one embodiment, the electrical distribution device also has a top surface with one or more power receptacles, communication connections, other electrical components that engage an electrical conduit, or electrical switches.

In some embodiments of the electrical distribution device, all of the pyramidal surfaces are laterally biased. In these preferred embodiments, the device also has a top surface with one or more power receptacles, communication connections, other electrical components that engage an electrical conduit, or electrical switches. The lateral bias is preferably uniformly clockwise or uniformly counterclockwise. Preferably, the electrical distribution device has three or more such adjacent pyramidal surfaces.

In other embodiments of the electrical distribution device, all of the adjacent pyramidal surfaces are downwardly biased. In some embodiments, the device also has a top surface with one or more power receptacles, communication connections, other electrical components that engage an electrical conduit, or electrical switches.

In embodiments of the electrical distribution device where all the adjacent pyramidal surfaces are downwardly biased, there are preferably three or more such adjacent pyramidal surfaces. In some embodiments, the device also has a top surface with one or more power receptacles, communication connections, other electrical components that engage an electrical conduit, or electrical switches.

In embodiments of the invention where all the adjacent pyramidal surfaces are downwardly biased, the length of relevant pyramidal surface below the relevant electrical outlet can optionally be adapted to accommodate 2.5 inches or more of downwardly oriented bulk of a transformer fitted in the power receptacle.

In certain embodiments of the electrical distribution device, on at least one such adjacent pyramidal surface, one or more power receptacles, communication connections, other electrical components that engage an electrical conduit, or electrical switches is located in the direction opposite the directional bias.

The electrical distribution device can optionally include an electrical lead for supplying power to the electrical distribution device and a spooling device for spooling the electrical lead. In some embodiments, the spooling device is spring-loaded to bias the device towards rewinding the electrical lead.

In another aspect, the invention relates to an electrical distribution device having three or more lateral surfaces, wherein at least two lateral surfaces are adjacent pyramidal surfaces having an angle between them of 90 degrees or less (and preferably, having an angle between them between 50 and 70 degrees). Each such adjacent pyramidal surface includes a directionally biased power receptacle; wherein each such adjacent pyramidal surface is adapted to direct a bulky end of a transformer fitted therein downwards or in a lateral direction. For downwardly biased adjacent pyramidal surfaces, the portion of the pyramidal surface below the power receptacle is adapted to accommodate about two inches or more of a bulky end of a transformer fitted in the power receptacle. Laterally-biased adjacent pyramidal surfaces are adapted so that no two such adjacent pyramidal surfaces direct bulky ends of fitted transformers towards the same, potentially conflicting space.

DETAILED DESCRIPTION OF THE INVENTION

Figure 1:
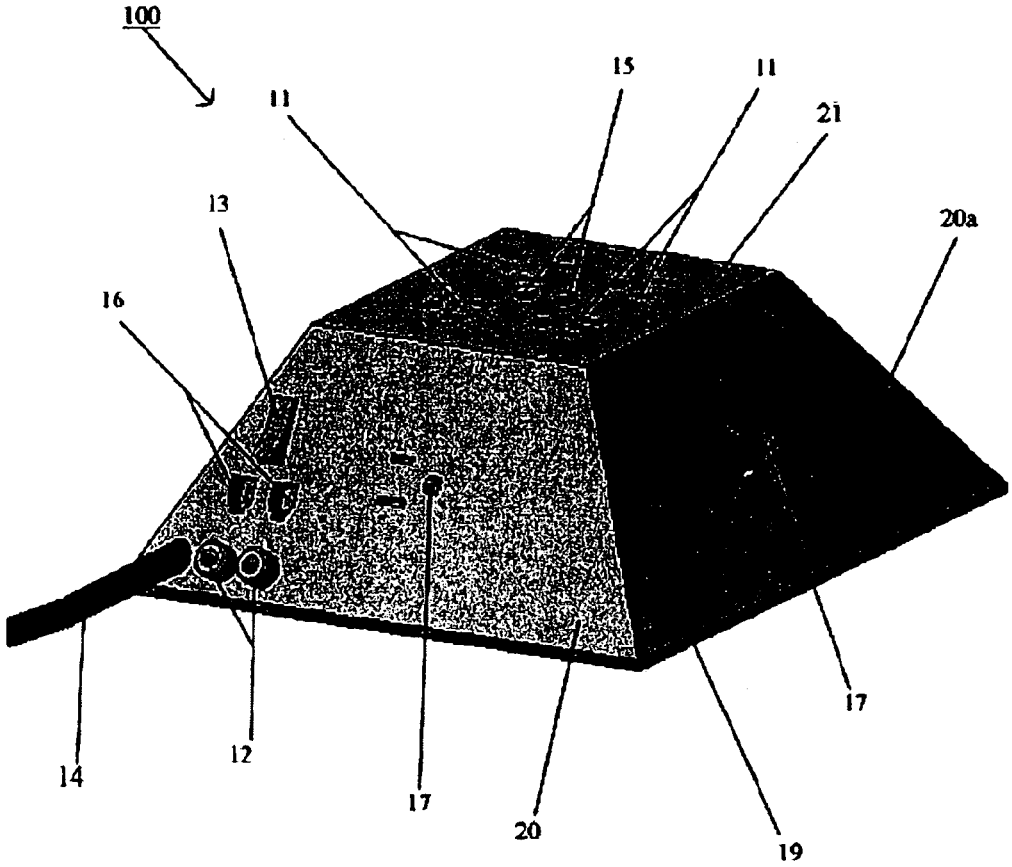
FIG. 1 is a perspective view of a multi-sided electrical power distribution device having adjacent pyramidal surfaces and a top surface, each with electrical power receptacle and/or communication jacks.
Figure 2:
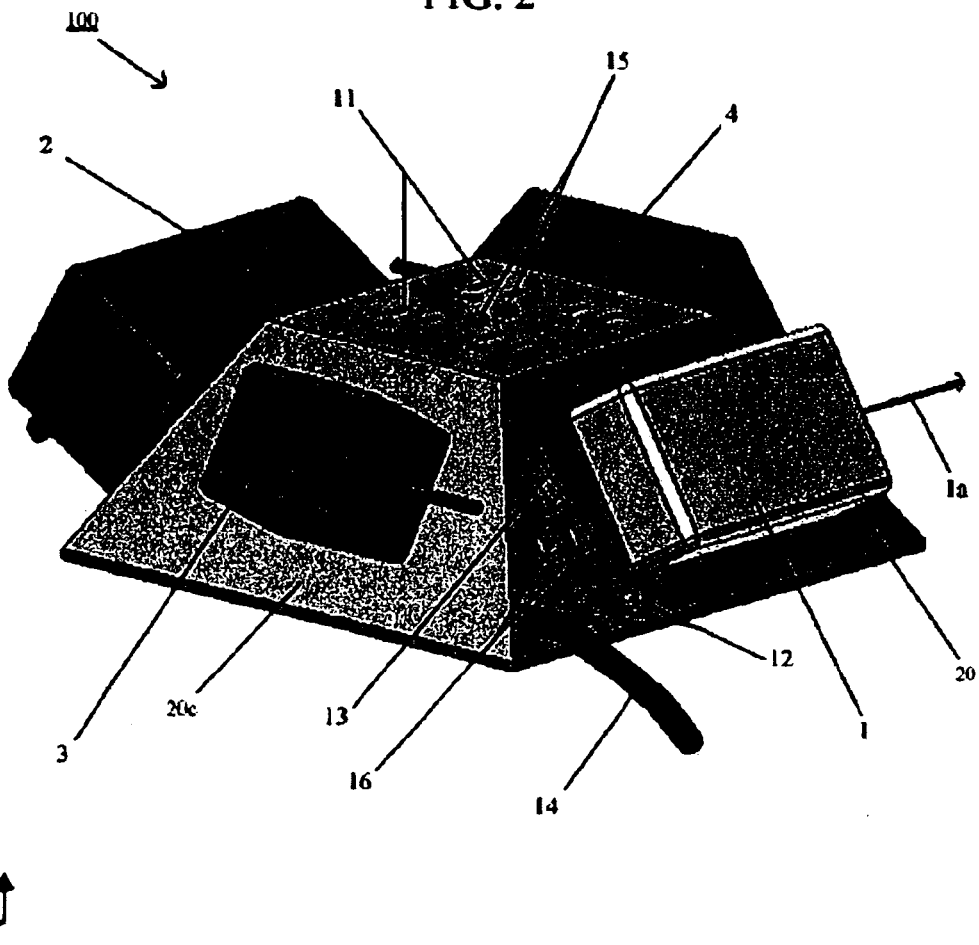
FIG. 2 is a perspective view showing multiple transformer blocks being powered by the present invention.
Figure 3:
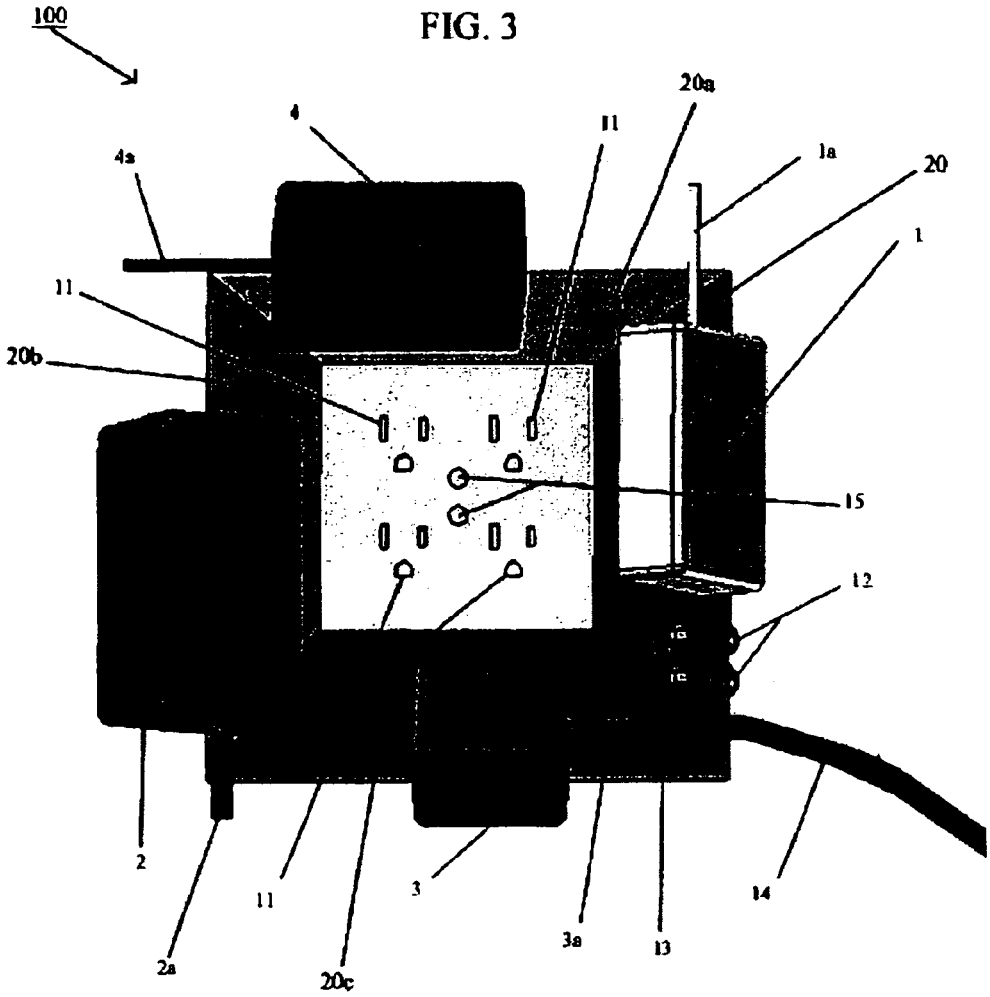
FIG. 3 is a top view of an electrical distribution device showing how longer transformer blocks extend beyond the underlying pyramidal surfaces without interfering with adjacent outlets.
Figure 4:
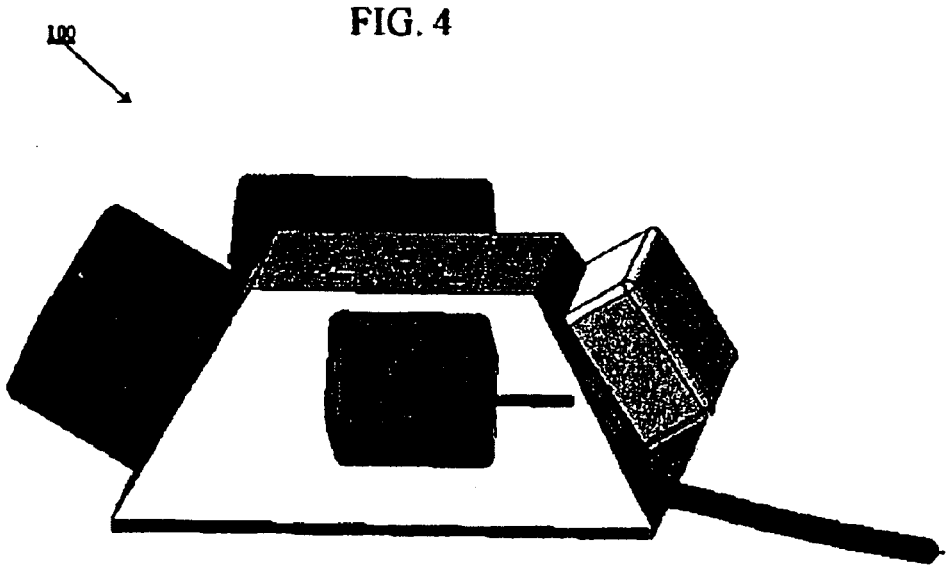
FIG. 4 is another perspective view of the electrical distribution device shown in FIG. 3.
Figure 5:
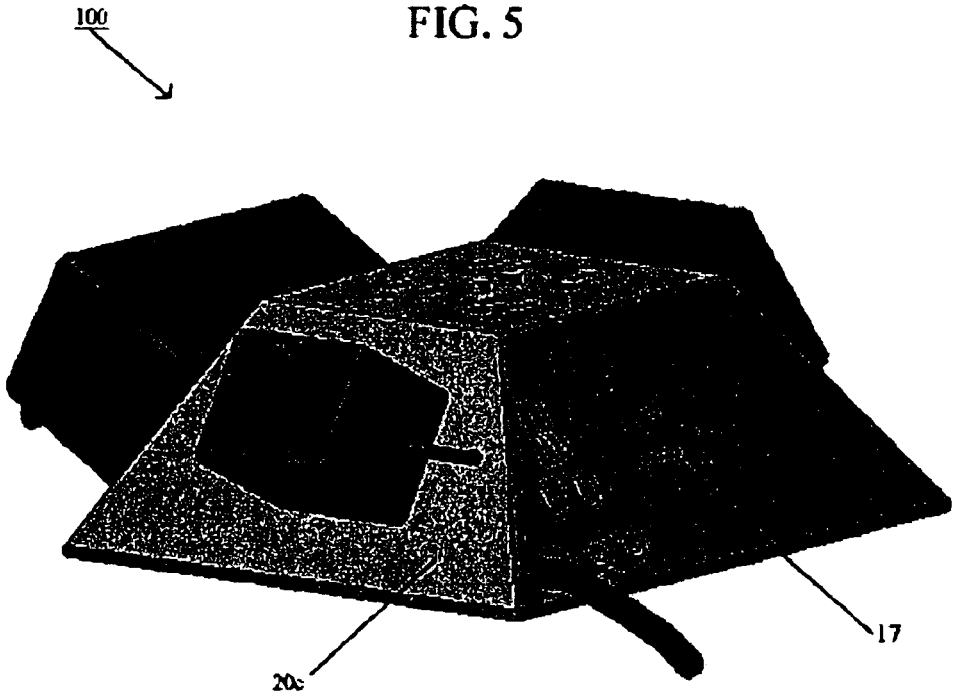
FIG. 5 is a perspective view of an electrical distribution device having adjacent pyramidal surfaces and a top surface with three connected transformer blocks.

The present invention provides an electrical distribution device having at least one pyramidal surface with a power receptacle and/or communication jacks. Ideally, the electrical distribution device has multiple pyramidal surfaces with outlets and/or communication jacks biased or aligned in such in a way as to position transformers or other large plugs away from adjacent power receptacles so that a space occupied by an article plugged into one receptacle does not conflict with the space occupied by an article plugged into a receptacle on an adjacent pyramidal surface. One power receptacle on the pyramidal surface is preferably either laterally biased or downwardly biased.

Further, in addition to the side-positioned outlet(s) and/or jack(s), the electrical power distribution device preferably has at least one upward-facing surface that provides at least one additional electrical and/or communication outlet or jack.

In a preferable embodiment of the present invention, the electrical distribution device has four lateral pyramidal surfaces and a top surface with any combination of power receptacles, communication jacks, status indicator lights, and/or a power switch positioned on any or all surfaces. This device allows for the simultaneous positioning of multiple transformers or large electrical plugs without interfering with coexisting outlets on the invention. Preferably, a manual or automatic means to coil the power cord is incorporated into the device. Also preferable is the use of surge protection circuitry for connected components. Another embodiment of the invention may incorporate the ability to provide power to connected devices via an uninterruptible power source (such as a battery) that may provide power at some or all power receptacles in the event of a power outage or accidental unplugging of the power cord. In such embodiments, the present invention may also provide the ability to automatically shut down connected computers or other connected equipment when a disconnected or failed power source is detected.

Other embodiments of the invention may include other than four sides. For example, three sides may be used to accommodate three transformer blocks. Similarly, greater than four sides may be used on a version designed to provide power to greater than four connected devices with transformer blocks.

While for maximum space efficiency it may preferable to have each pyramidal surface exist on its own plane having only one incorporated surface, other versions of the device may incorporate more than one surface. This may be useful for the incorporation of a power cord retraction or storage system like that shown in FIG. 6 and FIG. 7. It may also be done for aesthetic reasons or for the purpose of mounting the invention to a surface. Additional surfaces on any of the pyramidal surfaces may include non-linear surfaces.

The present invention is designed in such a way that it can be produced using metal, plastic or a combination thereof. Other variations of the design include mounting brackets or holes, or other means to mount the device to a wall, floor, table, or other surface.

In reference to the features of the present invention illustrated in the accompanying illustrations, Electrical Power Distribution Device 100, 200, 330, and 400 share several common features of relevance. For example, each has side power receptacles 17, 117, 217, 417; top receptacles 11, 111, 211, 411; power cord 14, 114, 214, 414 etc. For such elements, similar reference numbers are used but are characterized by a different leading number for consistency. These shared elements are not exclusive to any one version of the present invention and can exist on any embodiment of the design.

As shown in FIGS. 1–5, Electrical Power Distribution Device 100 has a plurality of power receptacles 11, 17 existing on multiple non-coplanar pyramidal surfaces 20, 20*a*, 20*b*, 20*c* or other surface and top surface 21. The positive, negative, and ground receptacles for power receptacles 11, 17 are dimensioned to accept the corresponding blades on attached electrical plugs, cords, or transformer blocks 1, 2, 3, 4 (whether grounded or not). Also included in the invention is power cord 14, 114, 214 to connect the Electrical Power Distribution Device to a power source.

The pyramidal surfaces 20, 20*a*, 20*b*, 20*c* of the Electrical Power Distribution Device 100 are preferably angled at an acute angle with the base 19 of the invention when viewed from the side so that the sides 20, 20*a*, 20*b*, 20*c* are upward-facing from the base 19. This allows for the connection of large plugs such as transformer block plugs 1, 2, 3, 4 to the sides of the Electrical Power Distribution Device 100 without gravitational forces acting to dislodge the connected cords 1, 2, 3, 4 from the Electrical Power Distribution Device 100. Equally as important, it allows for longer connected transformer plugs 1, 2, 4 to extend beyond their mated pyramidal surfaces 20, 20*a*, 20*b* respectively when connected to the Electrical Power Distribution Device 100 without interfering with or obstructing other side power receptacles 17 or top power receptacles 11. This allows for the simultaneous connection of a larger number of transformer block plugs than traditional power strips can currently provide power to. It also provides a more stable base than conventional designs.

In addition to power receptacles 11, 17, the present invention preferably includes video jacks 12 for devices such as cable-TV boxes, TV antennas, and satellite TV boxes that use coaxial cable and communication jacks 16 for devices, not limited to computers, telephones, fax machines, or other devices that use communication cables that terminate in the commonly used RJ11, RJ45, and other types of jacks. Communication 16 and video jacks 12 may be positioned on any pyramidal surface 20, 20*a*, 20*b*, 20*c*, or other surface, or on top surface 21. Alternatively, the communication jacks 16 or video jacks 12 may be positioned on a surface that is not shared with power receptacles 11, 17 (not shown), for aesthetic purposes for example. Preferably, the Electrical Power Distribution Device 100 offers protection for electrical surges and/or spikes for all devices connected to the power receptacles 11, 17 and/or the communication jacks 16 and video jacks 12. Any combination of communication jacks 16 or video jacks 12 may be used to provide surge or spike protection to more than one connected device.

Also preferable is a power button 13 that may be used to turn power on or off to some or all of the power receptacles on the present invention. Power button 13 may be lighted or positioned near a power or status indicating light 15 to indicate on/off power status. Power button 13 may be located on the pyramidal surfaces 20, 20*a*, 20*b*, 20*c* (as shown), or other surface, or on the top surface 21. Alternatively, the power button 13 may be positioned on a surface that is not shared with power receptacles 11, 17 (not shown), for aesthetic purposes, for example.

Preferably, at least one status indicator light 15 may be positioned on any surface of the present invention to indicate the status of the connection to an electrical ground, the ability to provide continued surge protection to connected devices, and/or the position of the power switch 13.

FIGS. 2, 3, 4, 5, 7 show connected devices that have transformer-type plug ends 1, 2, 3, 4 and associated power cords 1*a*, 2*a*, 3*a*, 4*a* connecting to transformer to the device. Ideally device power cords 1*a*, 2*a*, 3*a*, 4*a* extend away from the Electrical Power Distribution Device in such a way as to not interfere with power receptacles 11, 17, communication jacks 16, and video jacks 12. To achieve this, the power receptacles 11, 17 are preferably positioned laterally around the sides of the Electrical Power Distribution Device 100, 200 and oriented with the ground receptacles facing in the same direction as shown in the illustrations. It will be understood that other means of directionally biasing the power outlets, other than ground receptacles can be used. This alignment also positions the bulky ends of connected transformer plugs 1, 2, 3, 4 in such a way as to not interfere with adjacent side 17 or top 11 receptacles, or communication 16 and/or video jacks 12.

Figure 6:
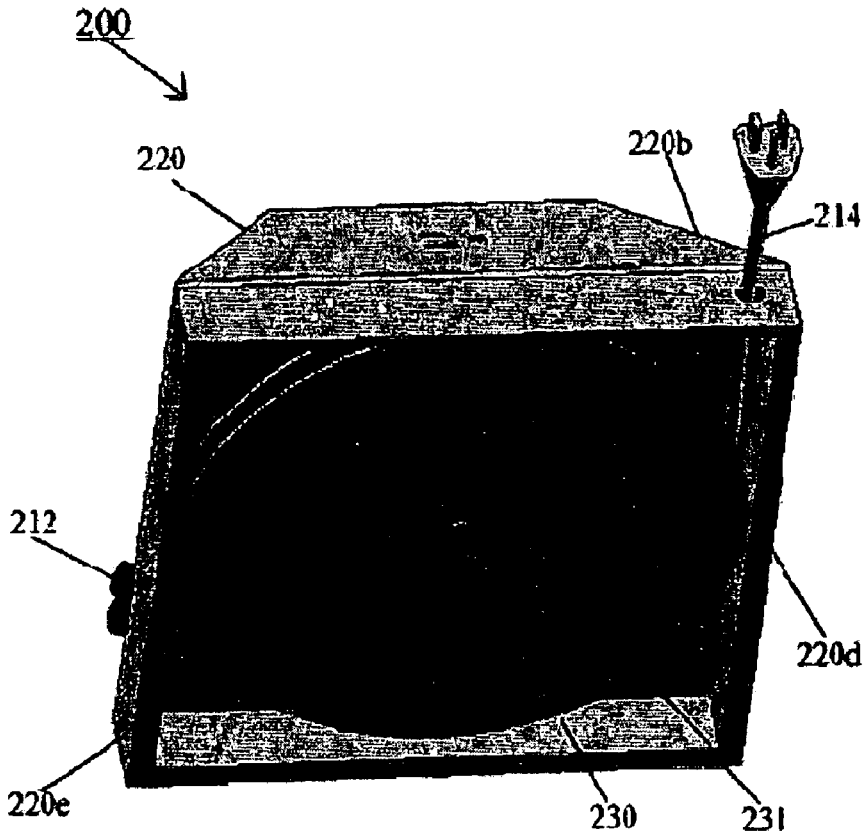
FIG. 6 is a bottom perspective view of an electrical distribution device showing a power cord spool for the winding of the power cord, which may be manual or spring-biased.
Figure 8:
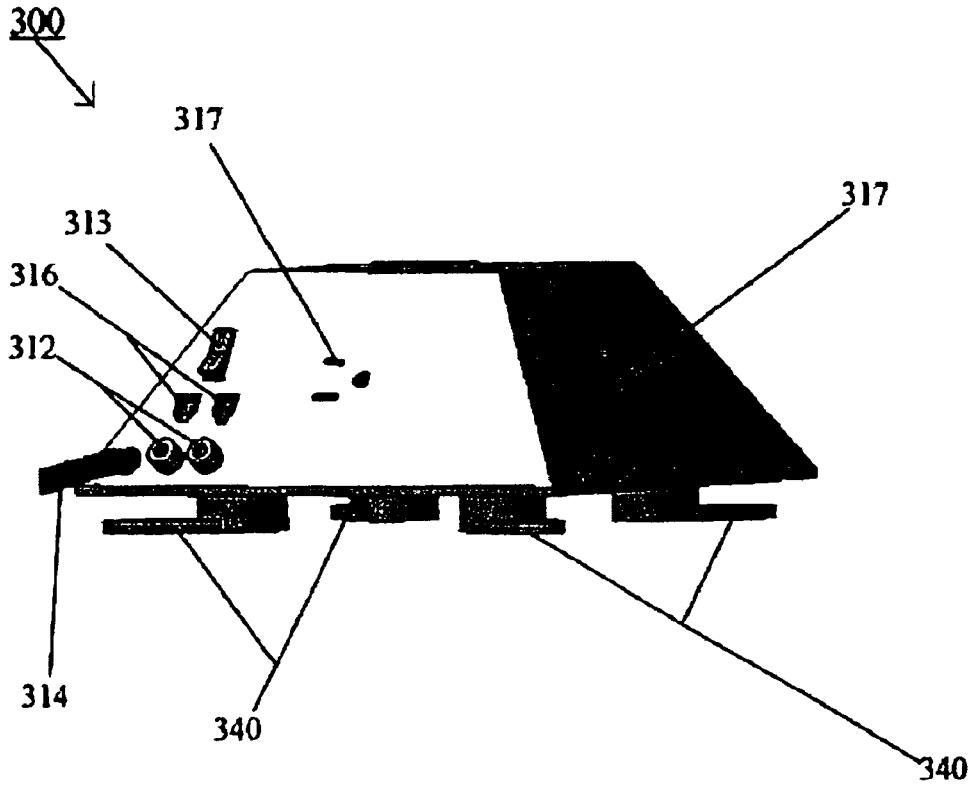
FIG. 8 is a perspective view of the electrical distribution device with ears on the bottom of the device adapted for manual winding and storage of the power cord.

In one embodiment of the invention it is preferable to offer a means of power cord management, especially for the storage and transport of the Electrical Power Distribution Device 100 when not in use. FIG. 6 shows a power cord management spool 231 in the base of the invention which is centered around pin 230 to permit the winding and storage of the power cord 14. Alternatively, this spool may be positioned nearer the top of the Electrical Power Distribution Device 200, to allow for increased space efficiency. In one variation of the design, the power cord management spool 231 may be fixed in position and require the manual winding of the power cord 214 around the spool 231. In another variation of the design, the spool 231 rotates around pin 230 to facilitate the winding of the power cord 214 by way of the manual winding of the spool 231. Alternatively, the spool 231 may retract in response to a spring-biased mechanism to facilitate the winding of the power cord 214. As an alternative, FIG. 8 shows an Electrical Power Distribution Device 300 that includes a plurality of winding ears 340 that may be adapted for the winding of the power cord 314 around the winding ears. In such embodiments of the present invention, winding ears 340 would also be used to form a base for the Electrical Power Distribution Device or can be used as a mounting surface for permanent installations of the device.

Figure 7:
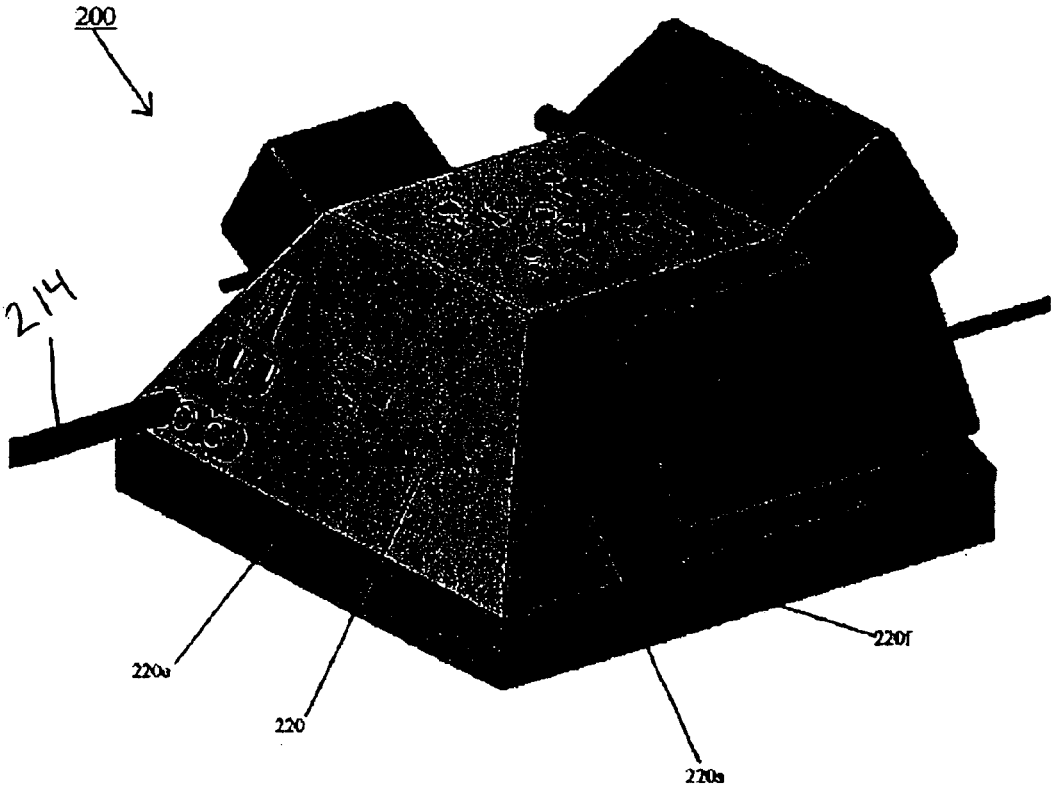
FIG. 7 is a perspective view of an electrical distribution device showing adjacent pyramidal surfaces having subsidiary surfaces existing on more than one plane.

FIG. 7 shows a variation of the Electrical Power Distribution Device 200 that includes a pyramidal surface defined by subsidiary surfaces 220*a* and 220*f* and another pyramidal surface defined by surfaces 220 and 220*e*, with each pyramidal surface existing on more than one plane. Similarly, FIG. 6 shows a bottom view of the Electrical Power Distribution Device 200 that includes a pyramidal surface defined by subsidiary surfaces 220*b* and 220*d* and another side defined by subsidiary surfaces 220 and 220*e*, with each pyramidal surface existing on more than plane. Alternatively, any or all of the sides may include a non-planar surface such as a spherical shape, which may be desirable for aesthetic reasons.

Figure 9:
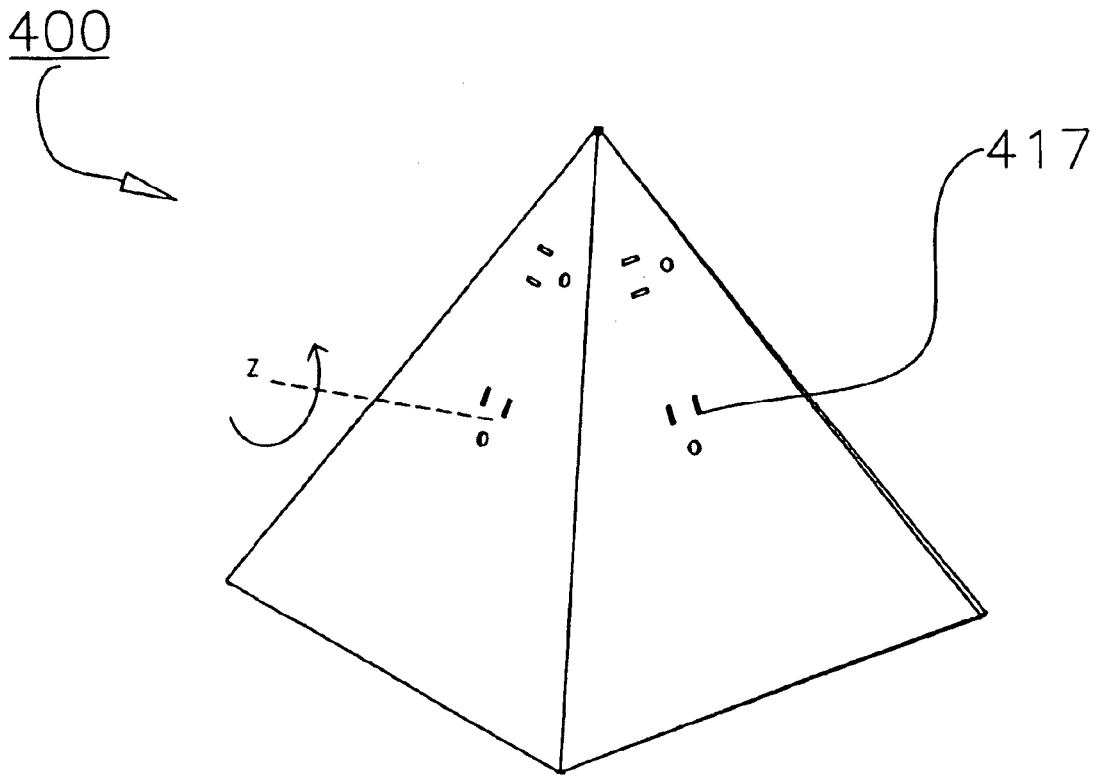
FIG. 9 is a perspective view showing an embodiment of the present invention without a flat top surface, having four pyramidal surfaces.

While for space efficiency and aesthetic purposes it may be generally preferable to use a top surface 21 existing on one plane, the top surface 21 can alternatively exist on any combination of two or more planar or non-planar surfaces, which may include any combination of power switches 13, power receptacles 11, 17, communication jacks 16, and video jacks 12 positioned throughout. In some embodiments of this arrangement, at least two of the pyramidal surfaces of the present invention may be heightened and meet at a point near the top of the Electrical Power Distribution Device. Such an embodiment may provide the ability to position power receptacles 11, 17 at multiple horizontal distances or heights from the base 19. FIG. 9 shows an embodiment of the present invention which is pyramid shaped and therefore does not have a flat surface on the top. In such embodiments, power receptacles 417, video jacks 412, and communication jacks 416, can be positioned at more than one level as shown in FIG. 9. In this, and in any other embodiments of the present invention, power receptacles 417, video jacks 412, and communication jacks 416 can be rotated 0 to 360 degrees approximately around center axis Z. This may allow for additional room to position more outlets on the present invention.

Figure 10:
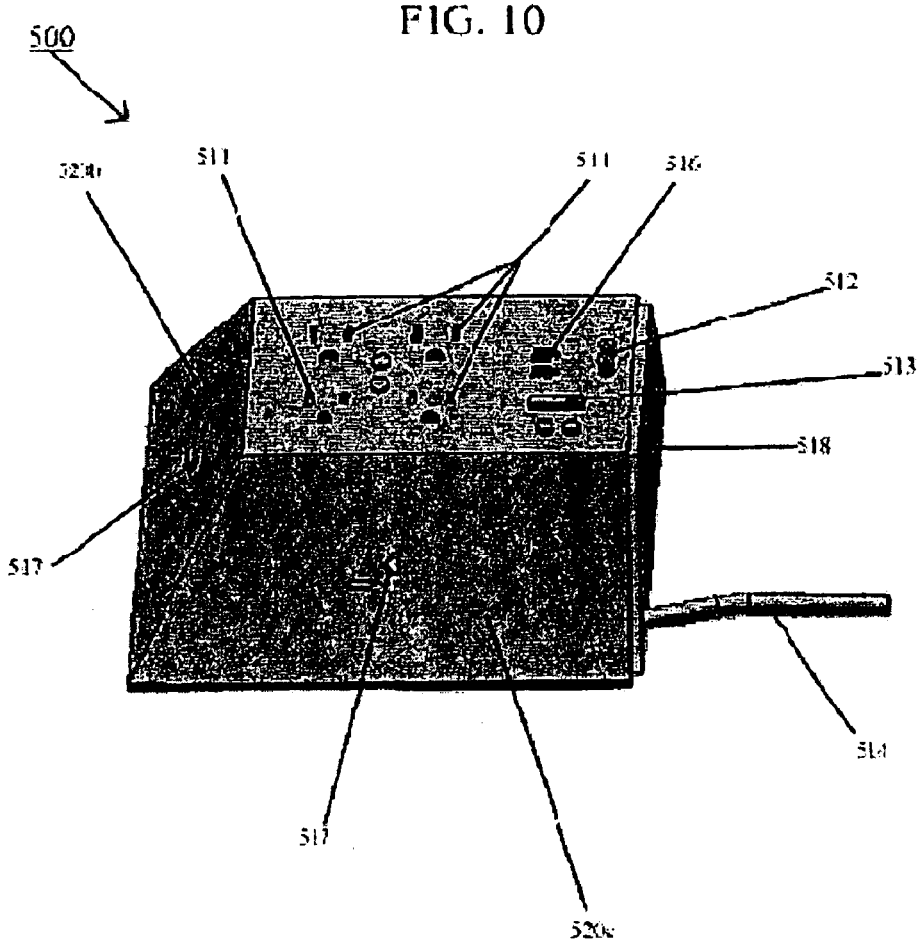
FIG. 10 is a perspective view showing an embodiment of the invention having one side of the device that is not a pyramidal surface.
Figure 11:
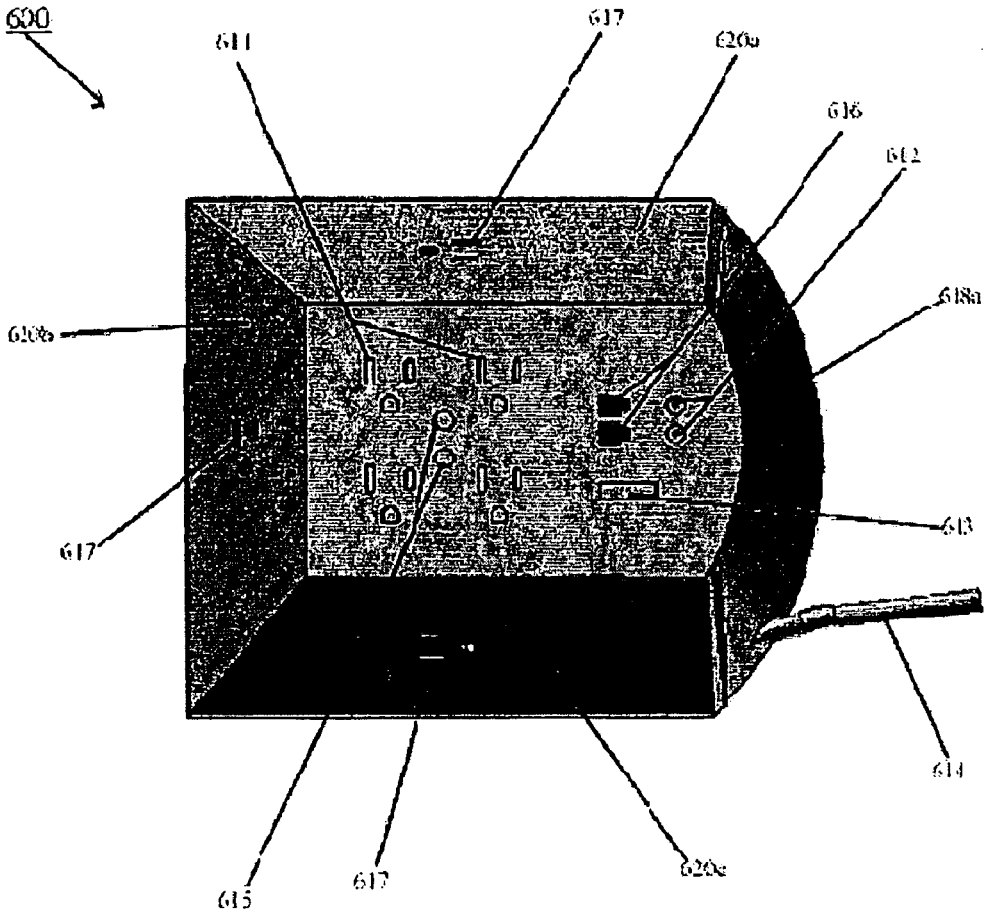
FIG. 11 is a perspective view showing an embodiment of the invention having a side with a non-planar or spherical surface.
Figure 13:
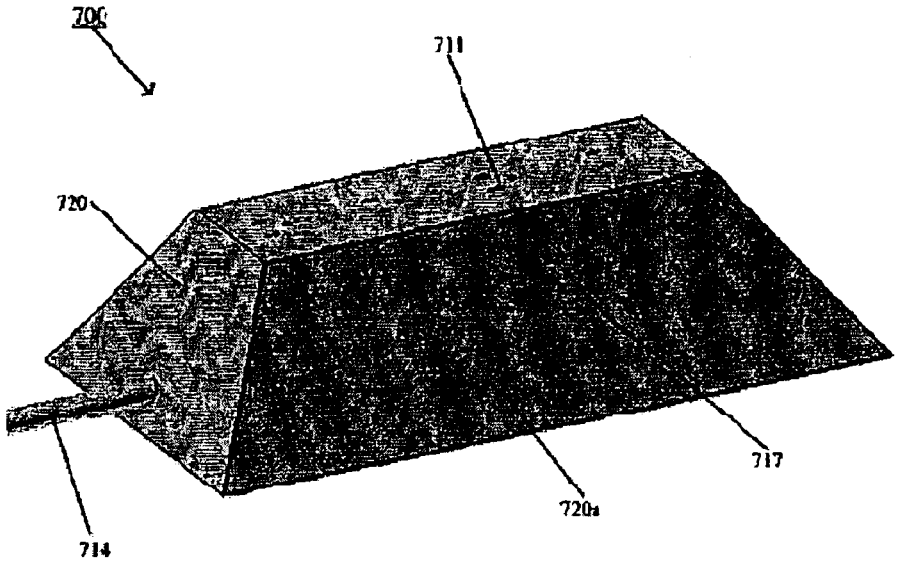
FIG. 13 is a perspective view of an electrical distribution device showing adjacent pyramidal surfaces with elongated sides supporting directionally opposed transformers in a lateral orientation.
Figure 14:
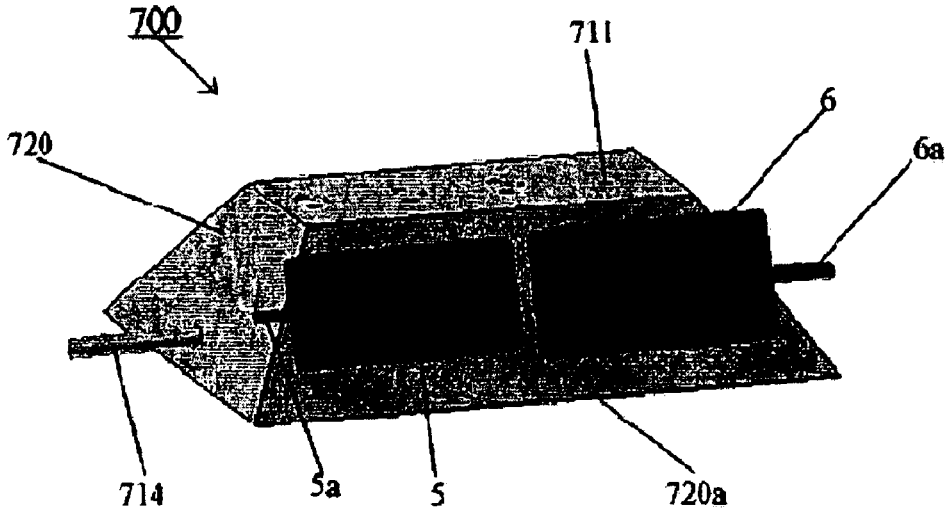
FIG. 14 is a perspective view of an electrical distribution device showing adjacent pyramidal surfaces with elongated sides supporting directionally opposed transformers in a lateral orientation with two large transformer style plugs connected.

While for maximum space efficiency and aesthetic reasons it may be preferable that the invention is constructed with sides that are generally of the same size, shape, and angled position with each other, variations of the design may include non-symmetrical sides. For example, in some variations of the present invention, not all sides may include an angled surface adapted for a transformer plug 1, 2, 3, 4. This may be desirable for the aesthetic positioning of the power switch 14, the video jack 12, or the communication jacks 16. For example, FIG. 10 shows power distribution device 500 having one side 518 that does not include a receptacle or jack. In another embodiment of the present invention, at least one side predominately consists of a non-planar or spherical surface 618A, such as in seen in the device 600 in FIG. 11. In additional embodiments of the present invention as shown in FIG. 13 and FIG. 14, the Electrical Power Distribution Device may alternatively be of rectangular shape when viewed from the top, allowing for the placement of additional power receptacles 711, 717, video jacks, or communication jacks on the long sides that would be formed by the rectangular shape. The longer sides in such embodiments may allow for the placement of lateral outlets 5, 6 that are oriented 180 degrees from each other as shown in FIG. 14. Such placement would direct the bulky ends of the transformers and the transformer cords 5*a*, 6*a* away from the sides of the invention without causing interference with adjacent power receptacles. Similarly, greater than four sides may be used to achieve the same purpose.

The electrical distribution device is described with reference to how it addresses the problem of fitting multiple, bulky transformers into a power supply. Of course, other large electrical devices, many of them with a bulky end such as found in transformers, also raise this same issue. Thus, the invention can be used to help fit these devices on a power supply. Examples of such other bulky devices include battery charging devices, radio communication devices, computer equipment, audio/video equipment, and/or any other device that requires the transformation of standard line voltage to a lesser voltage via an external transformer positioned on the power cord.

Definitions

The following terms shall have, for the purposes of this application, the respective meanings set forth below.

Angle Between Adjacent Pyramidal Surfaces

The angle between two pyramidal surfaces is defined by the lines defined by the intersection of the flat transformer-supporting surfaces thereon with a plane that is parallel to the bottom of the electrical distribution device.

Bulky End of a Transformer

Figure 12:
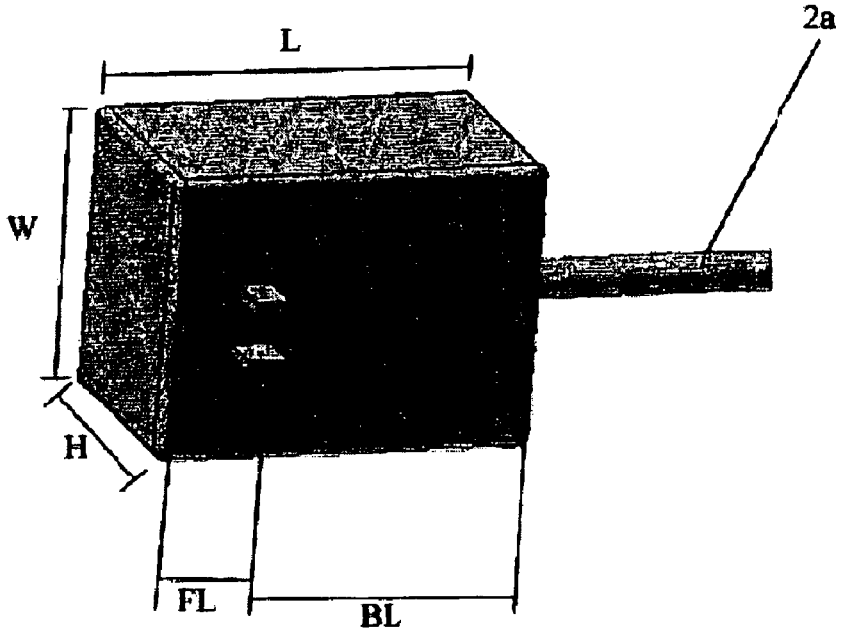
FIG. 12 is a perspective view of a transformer type plug that does not have a grounded receptacle.

A transformer has a height H, a width W (which for the purpose of this definition is symmetrical about the midpoint of the electrical connectors), overall length L, front length FL (from the midpoint of the electrical connectors forward), and back length BL (from the midpoint of the electrical connectors rearwards), as illustrated in FIG. 12. The portion of a transformer defined by BL is the bulky end.

Downwardly-biased Pyramidal Surface

A downwardly-biased pyramidal surface is a pyramidal surface that has a directionally biased power receptacle that is adapted to direct a bulky end of a transformer fitted therein in a downward direction. Power receptacles can be biased with the shape or size of electrical prongs, or the like. While not preferred, the downward directional bias can allow: (i) positioning of, e.g., a transformer, in the direction to provide the non-overlap advantage of the invention; and (ii) positioning 180° C. in the other orientation. In this latter case, the space-saving positioning is used as required.

Laterally-biased Pyramidal Surface

A laterally-biased pyramidal surface is a pyramidal surface that has a directionally biased power receptacle that is adapted to direct a bulky end of a transformer fitted therein laterally around the pyramidal side of the invention, taking advantage of the non-interfering, overlap advantage of the invention. Power receptacles can be biased with the shape or size of electrical prongs, or the like. Here again, while not preferred, the lateral directional bias can allow: (i) positioning of, e.g., a transformer, in the direction to provide the non-overlap advantage of the invention; and (ii) positioning 180° C. in the other orientation. In this latter case, the space-saving positioning is used as required.

Pyramidal Surface

A pyramidal surface is one where the segment of which that is adapted to have a transformer rest upon it is flat, and that flat segment is at an angle adapted so that a portion of the weight of a transformer fitted into the appropriate electrical outlet on the pyramidal surface will be conveyed to such flat segment instead of being conveyed to the electrical fittings, such portion sufficient to enhance the stability of a transformer's placement in the electrical outlet and on the flat segment.

Transformer of High Basal Bulk

A transformer of high basal bulk is one whose dimensions of H, FL and W (see "bulky end" definition above) are 1.5, 0.5 and 2 inches, respectively. (Using the laterally oriented pyramidal surfaces of the invention and assuming no more the high basal bulk, the BL can be of any length)

Publications and references, including but not limited to patents and patent applications, cited in this specification are herein incorporated by reference in their entirety in the entire portion cited as if each individual publication or reference were specifically and individually indicated to be incorporated by reference herein as being fully set forth. Any patent application to which this application claims priority is also incorporated by reference herein in the manner described above for publications and references.

While this invention has been described with an emphasis upon preferred embodiments, it will be obvious to those of ordinary skill in the art that variations in the preferred devices and methods may be used and that it is intended that the invention may be practiced otherwise than as specifically described herein. Accordingly, this invention includes all modifications encompassed within the spirit and scope of the invention as defined by the claims that follow.

What is claimed is:

1. An electrical distribution device comprising three, four or five side surfaces, and a top surface comprising one or more power receptacles;

wherein at least three said side surfaces are adjacent and are substantially flat pyramidal surfaces, wherein an adjacent two of said adjacent pyramidal surfaces (designated a first and second pyramidal surface) each comprise a power receptacle that fits a transformer with a bulky end with the transformer bulk biased laterally, the bias for these two laterally biased power receptacles being uniformly clockwise or uniformly counterclockwise with bias of said power receptacle on the first pyramidal surface being towards the second pyramidal surface, wherein, for said first and second pyramidal surfaces, each provides sufficient flat surface about its said respective laterally-biased power receptacle such that (i) it accommodates a transformer of high basal bulk (H of 1.5 inches, W of 2 inches and FL of 0.5 inches) fitted therein consistent with the lateral bias such that all of the transformer rests on flat surface and (ii) it accommodates a transformer of high basal bulk having any length L is so fitted such that the portion of such transformer on the respective pyramidal surface is on a flat, recepticle-free surface that supports the transformer, wherein the first pyramidal surface is such that a transformer, when fitted in the respective said laterally-biased receptacle consistent with the lateral bias would, if sufficiently long, extend over an edge of the first side surface towards the second pyramidal surface, but so extend at an angle and plane such that a transformer of high basal bulk can still be fitted into any power receptacle on the second pyramidal surface, and wherein the electrical distribution device has a base that rests or mounts on a flat surface.

2. The electrical distribution device of claim 1, wherein the top surface comprises two to four power receptacles.

3. The electrical distribution device of claim 2, wherein no adjacent pyramidal surfaces direct bulky ends of transformers towards the same, potentially conflicting space.

4. The electrical distribution device of claim 1, wherein wherein no adjacent pyramidal surfaces direct bulky ends of transformers towards the same, potentially conflicting space.

5. The electrical distribution device of claim 1, wherein laterally-biased power outlets that engage and support transformers on the first or second pyramidal surface consist of, for each such side, the above-recited power receptacle and up to one additional power receptacle that accommodates, consistent with its lateral bias, a transformer of high basal bulk with all of the transformer resting on flat surface.

6. The electrical distribution device of claim 1, further comprising an electrical lead for supplying power to the electrical distribution device and a spooling device for spooling the electrical lead.

7. The electrical distribution device of claim 6, wherein the spooling device comprises winding ears that form a base for the electrical distribution device.

8. The electrical distribution device of claim 7, wherein no adjacent pyramidal surfaces direct bulky ends of transformers towards the same, potentially conflicting space.

9. The electrical distribution device of claim 7, wherein the top surface comprises two to four power receptacles.

10. The electrical distribution device of claim 9, wherein no adjacent pyramidal surfaces direct bulky ends of transformers towards the same, potentially conflicting space.

11. The electrical distribution device of claim 1, wherein one said pyramidal surface consists of one said associated laterally-biased power outlet, and comprises, located on the opposite side of that laterally-biased power outlet from where the bulky end of a fitted transformer would be directed, a power switch.

12. An electrical distribution device having four side surfaces that have an angle between them of 90 degrees, and a top surface comprising one or more power receptacles, wherein at least three said side surfaces are adjacent and are substantially flat pyramidal surfaces, wherein an adjacent two of said adjacent pyramidal surfaces (designated a first and second pyramidal surface) each comprise a power receptacle that is fits a transformer with a bulky end with the transformer bulk biased laterally, the bias for these two laterally biased power receptacles being uniformly clockwise or uniformly counterclockwise with bias of said power receptacle on the first pyramidal surface being towards the second pyramidal surface, wherein, for said first and second pyramidal surfaces, each provides sufficient flat surface about its said respective laterally-biased power receptacle such that (i) it accommodates a transformer of high basal bulk (H of 1.5 inches, W of 2 inches and FL of 0.5 inches) fitted therein consistent with the lateral bias such that all of the transformer rests on flat surface and (ii) it accommodates a transformer of high basal bulk having any length L is so fitted such that the portion of such transformer on the respective pyramidal surface is on a flat, recepticle-free surface that supports the transformer, and wherein the electrical distribution device has a base that rests or mounts on a flat surface.

13. The electrical distribution device of claim 12, wherein the top surface comprises two to four power receptacles.

14. The electrical distribution device of claim 13, wherein no adjacent pyramidal surfaces direct bulky ends of transformers towards the same, potentially conflicting space.

15. The electrical distribution device of claim 12, wherein wherein no adjacent pyramidal surfaces direct bulky ends of transformers towards the same, potentially conflicting space.

16. The electrical distribution device of claim 12, wherein laterally-biased power outlets that engage and support transformers on the first or second pyramidal surface consist of, for each such side, the above-recited power receptacle and up to one additional power receptacle that accommodates, consistent with its lateral bias, a transformer of high basal bulk with all of the transformer resting on flat surface.

17. The electrical distribution device of claim 12, further comprising an electrical lead for supplying power to the electrical distribution device and a spooling device for spooling the electrical lead.

18. The electrical distribution device of claim 17, wherein the spooling device comprises winding ears that form a base for the electrical distribution device.

19. The electrical distribution device of claim 18, wherein no adjacent pyramidal surfaces direct bulky ends of transformers towards the same, potentially conflicting space.

20. The electrical distribution device of claim 18, wherein the top surface comprises two to four power receptacles.

* * * * *